US009941562B2

(12) United States Patent
Robin et al.

(10) Patent No.: US 9,941,562 B2
(45) Date of Patent: Apr. 10, 2018

(54) MICROWAVE-FREQUENCY FILTERING STRUCTURES

(71) Applicant: AIRBUS DS ELECTRONICS AND BORDER SECURITY SAS, Elancourt (FR)

(72) Inventors: Michel Robin, Marly le Roi (FR); Guillaume Tolleron, Les Clayes Sous Bois (FR)

(73) Assignee: AIRBUS DS ELECTRONICS AND BORDER SECURITY SAS, Elancourt (FR)

( * ) Notice: Subject to any disclaimer, the term of this patent is extended or adjusted under 35 U.S.C. 154(b) by 69 days.

(21) Appl. No.: 14/651,896

(22) PCT Filed: Nov. 22, 2013

(86) PCT No.: PCT/EP2013/003558
§ 371 (c)(1),
(2) Date: Aug. 18, 2015

(87) PCT Pub. No.: WO2014/090375
PCT Pub. Date: Jun. 19, 2014

(65) Prior Publication Data

US 2016/0006095 A1 Jan. 7, 2016

(30) Foreign Application Priority Data

Dec. 14, 2012 (FR) ..... 12 03420

(51) Int. Cl.
*H01P 3/08* (2006.01)
*H01P 1/20* (2006.01)
(Continued)

(52) U.S. Cl.
CPC ..... *H01P 1/2002* (2013.01); *H01P 3/081* (2013.01); *H01P 5/028* (2013.01); *H01P 1/20363* (2013.01)

(58) Field of Classification Search
CPC ..... H01P 1/2002; H01P 3/081; H01P 5/028; H01P 1/20363
(Continued)

(56) References Cited

U.S. PATENT DOCUMENTS 3,135,935 A * 6/1964 Eugelbrecht ..... H01B 13/016 112/440
6,329,890 B1 12/2001 Brooks et al.
(Continued)

FOREIGN PATENT DOCUMENTS

EP 1 508 935 A1 2/2005

OTHER PUBLICATIONS

International Search Report as issued in International Patent Application No. PCT/EP2013/003558, dated Mar. 14, 2014.
(Continued)

*Primary Examiner* — Robert J Pascal
*Assistant Examiner* — Kimberly Glenn
(74) *Attorney, Agent, or Firm* — Pillsbury Winthrop Shaw Pittman LLP

(57) ABSTRACT

A microwave-frequency filtering structure includes two dielectric layers separated by a conducting layer that is etched in the pattern of a filter, the upper and lower exterior faces of the stack being covered over the larger part of their surface by a conducting plane constituting ground planes of the structure, which are interlinked by a metallization of the periphery of the structure; two identical devices, an input and an output transition device, each allowing the passage from a microstrip mode to a stripline mode and vice versa, configured so that the geometry of the transition device is
(Continued)

optimized to minimize the standing wave ratios at the ports of the filter, and to minimize the excitation and the coupling of the TE10 mode, two conducting pillars perpendicular to the plane of the structure and situated close to its principal axis, without being coupled with the filter, and linking the upper and lower ground planes.

7 Claims, 2 Drawing Sheets

(51) Int. Cl.
*H01P 5/02* (2006.01)
*H01P 1/203* (2006.01)

(58) Field of Classification Search
USPC ..... 333/204
See application file for complete search history.

(56) References Cited

U.S. PATENT DOCUMENTS

2007/0063789 A1 3/2007 Dalconzo et al.
2012/0182093 A1* 7/2012 Vickes ..... H01P 1/20372 333/204

OTHER PUBLICATIONS

Leib, M. et al., "An Ultra-Wideband Vertical Transition from Microstrip to Stripline in PCB Technology," Proceedings of 2010 IEEE International Conference on Ultra-Wideband (ICUWB2010), XP031784283, ISBN: 978-1-4244-5305-4.

* cited by examiner

MICROWAVE-FREQUENCY FILTERING STRUCTURES

CROSS-REFERENCE TO RELATED APPLICATIONS

This is the U.S. National Stage of PCT/EP2013/003558, filed Nov. 22, 2013, which in turn claims priority to French Patent Application No. 12/03420, filed Dec. 14, 2012, the entire contents of all applications are incorporated herein by reference in their entireties.

FIELD OF THE INVENTION

The present invention relates to a microwave-frequency filtering structure. More particularly, the invention relates to the field of stripline structures.

STATE OF THE ART AND TECHNICAL PROBLEMS ENCOUNTERED

In the state of the art, there are so-called stripline structures (or also called tri-plate structures). By stripline structure, it is meant a form of transmission electromagnetic medium which uses a flat metal tape provided between two electrical insulators, also called dielectrics, being metallized on their exterior surface. These stripline structures have numerous advantages with respect to microstrip structures. By the so-called microstrip structure, it is meant a type of electrical transmission line which can be manufactured using the standard manufacturing process for electronic boards, and which is employed in microwave-frequency techniques. This microstrip structure is comprised of a conduction band separated from a ground plane by a dielectric layer. The advantage of the stripline structure with respect to a microstrip structure is on the one hand that the propagation is made in a Transverse Electro Magnetic (TEM) mode.

On the other hand, the stripline structure has its own electromagnetic shielding and hence does not radiate. Further, such a stripline structure is able to be separately insulated and tested, and then to be integrated as easily as a CMS component on a microwave-frequency printed circuit board. Finally, for a same dielectric material, in other words which has the same substrate permittivity, the stripline structures are of lower dimensions for a function equivalent to those of the microstrip structures.

However, the main drawback of the stripline structures is that transmission losses in the dielectric are higher than those exhibited by the equivalent structure in microstrip technology.

However, the progress now made on microwave-frequency dielectric substrates minimizes the impact of this drawback.

For that reason, the stripline structures are thus ideal for making microwave-frequency passive circuits such as couplers and filters.

In the example of FIG. 1, a band-pass filtering device which is widely used in the microwave-frequency field is illustrated. It uses coupling properties between transmission lines to make a series of resonators coupled to the adjacent resonators. The calculation mode of this device is well known. It resorts to various approximations which turn out to be sufficiently accurate in practice. Making such a filter results in a distortion occurring in the frequency response |S21 (f)|. This distortion is generally:

- ascribed to etching in accuracies of a printed circuit, or
- ascribed to the combination of the imperfections of microstrip/stripline and stripline/microstrip transitions, or
- masked by losses in the passband if the latter is narrow, or if the dielectric substrate has too low a quality factor Q.

This distortion also appears outside the passband as spurious responses, in particular at frequencies higher than the centre frequency of the filter, as the high stop band.

The synthesis of the band-pass filter can be checked using an electromagnetic simulator. It is noticed by means of the electromagnetic simulator that the distortion observed and the spurious responses are due to the establishment of a TE10-type guided propagation mode.

DISCLOSURE OF THE INVENTION

The present invention aims at solving all the drawbacks of the state of the art. For this, the invention provides a new integratable filter structure the frequency response of which is free of distortion and of spurious response on a wide frequency band, thereby improving notably the filtering performance.

Thus, one object of the invention is to provide a microwave-frequency filtering structure characterized in that it includes:

- two dielectric layers separated by a conducting layer, the conducting layer being etched in the pattern of a filter,
- the upper and lower exterior faces of the stack of the two dielectric layers being covered over the larger part of their surface by a conducting plane constituting ground planes of the structure,
- said ground planes being interlinked by a metallization of the periphery of the structure, except in the vicinity of the microwave-frequency ports,
- two identical devices, one of them being an input transition device and one being an output transition device, each allowing the passage from a microstrip mode to a stripline mode and vice-versa, configured such a way that the geometry of the transition device is optimized so as to minimize the standing wave ratios at the ports of the filter, and to also minimize the excitation and the coupling of the TE10 mode,
- at least two conducting pillars perpendicular to the plane of the structure, which are situated as close as possible to its principal axis, without there being any coupling with the filter, and linking the upper and lower ground planes.

The invention includes, any of the following characteristics:

- the transition devices, each include:
  - a metallized pad situated on its lower face and on the minor side of the filter,
  - an interconnection hole allowing the connection between the metallized pad and the stripline access line of the filter, and
  - eight metallized pillars connected at each end to the ground planes;
- the transition devices enable the structure according to the invention to be assembled to a microwave-frequency microstrip-type printed circuit by soldering;
- the pillars are made as metallized interconnection holes passing through the two dielectric layers;
- the pillars are solid metal rods.

One object of the invention is also to provide a printed circuit including a set of active and/or passive components, characterized in that it includes one or more structure(s), according to any of the preceding characteristics.

BRIEF DESCRIPTION OF THE FIGURES

The invention will be better understood upon reading the description that follows and upon examining the accompanying figures. These are only presented by way of illustrating purposes, but in no way limiting for the invention. The figures show.

DESCRIPTION OF THE INVENTION

It is now noticed that the figures are not drawn to scale.

The following embodiments are examples. Although the description refers to one or more embodiments, this does not necessarily mean that each reference relates to the same embodiment, or that the characteristics only apply to a single embodiment. Simple characteristics of different embodiments can also be combined to provide other embodiments.

The invention which will be described hereinafter aims at providing a new integratable filter structure the frequency response of which is free of distortion and of spurious response on a wide frequency band, thereby improving the filtering performance.

Figure 1:
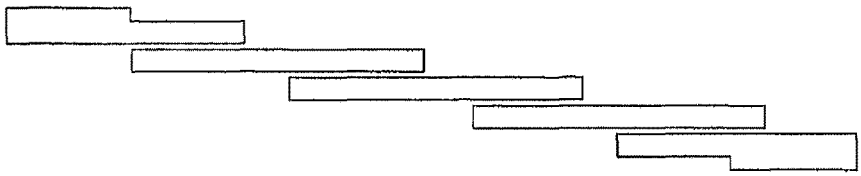
FIG. 1: schematic representation of a filter feasible in striplines, according to the state of the art.
Figure 2:
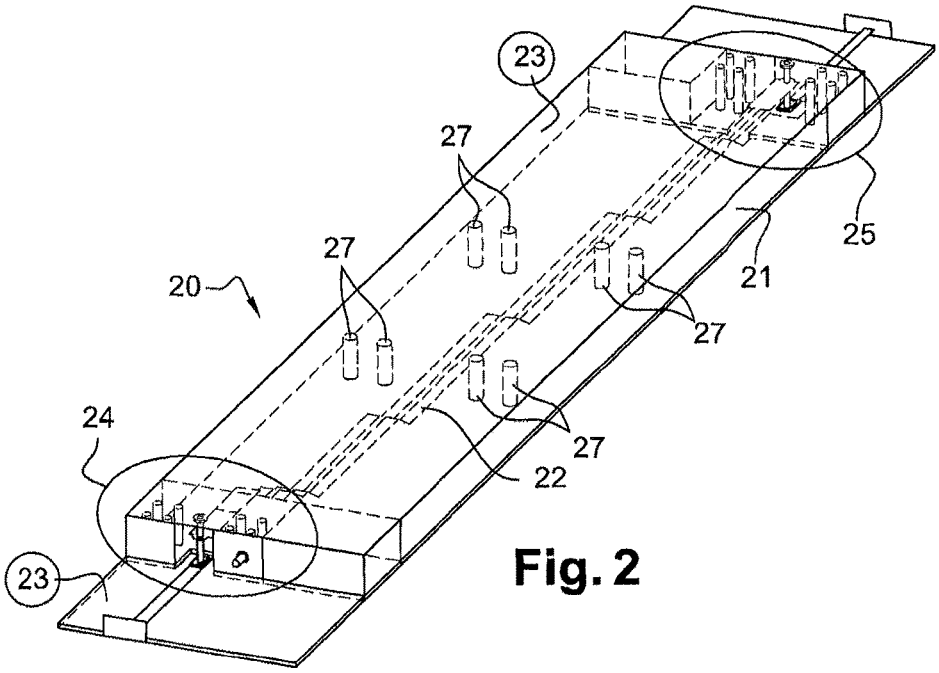
FIG. 2: overview of the structure, according to one embodiment of the invention.

FIG. 2 illustrates an overview of the structure, according to one embodiment of the invention. In this FIG. 2, a stripline structure 20 is comprised of two dielectric layers 21, 23 separated by a conducting layer 22. The conducting layer 22 is etched in the pattern of a filter according to the principle of FIG. 1. The filter according to FIG. 1 is described in more detail in documents hereinafter referenced as "George L. Matthaei, Leo Young & E. M. T. Jones. Microwaves Filters, Impedance-Matching Networks and Coupling Structures. Editions McGraw-Hill Inc".

In the rest of the description, the conducting layer 22 will be called a filter 22. The upper and lower exterior faces of the stack of both dielectric layers 21, 23 are covered over the larger part of their surface with a conducting plane (not represented to facilitate the understanding of FIG. 2) constituting the ground planes of the structure 20. The ground planes are interlinked by a metallization of the periphery of the structure 20 except in the vicinity of the microwave-frequency ports.

Figure 3:
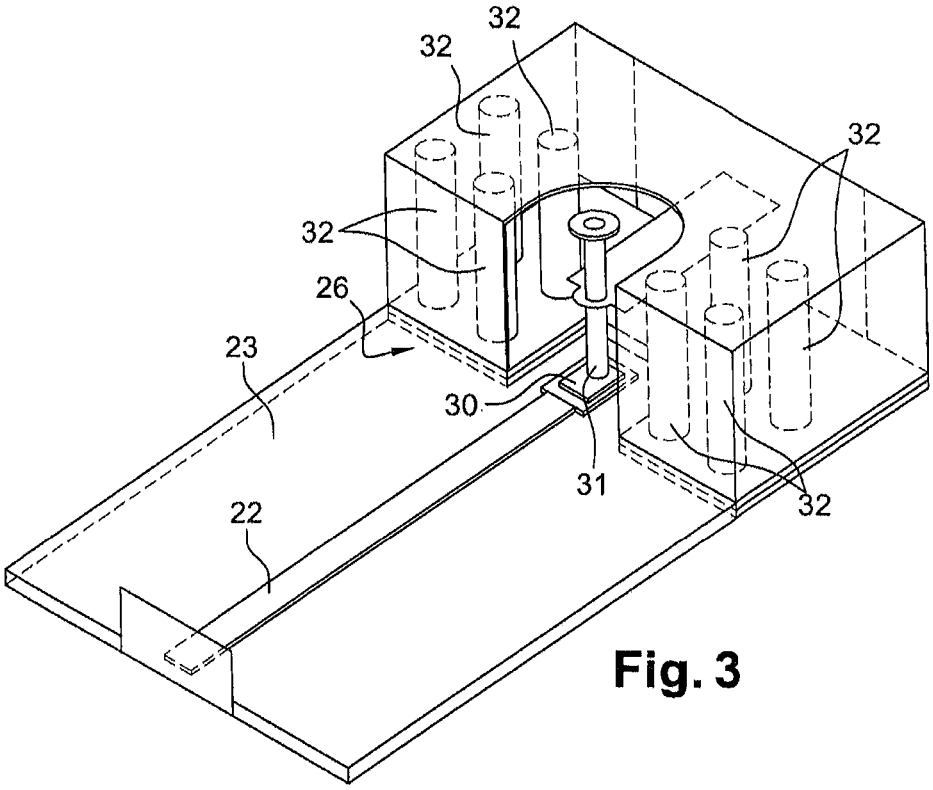
FIG. 3: detailed view of the stripline/microstrip transition, according to one embodiment of the invention.

The structure 20 also includes two identical devices 24, 25, one of them being an input transition device 24 and another one being an output transition device 25, illustrated in FIG. 3. These devices 24, 25 allow the passage from a microstrip mode to a stripline mode and vice-versa. These devices 24, 25 each include:

- a metallized pad 30 situated on its lower face and on the minor side 26 of the filter 22 as well as an interconnection hole 31 allowing the connection between the metallized pad and the stripline access line of the filter 22, and
- eight metallized pillars 32 connected at each end to the ground planes.

The geometry of the transition device 24, 25 is optimized in order to minimize the Voltage Standing Wave Ratio (SWR) at the ports of the filter 22 and also to minimize the excitation and coupling of the TE10 mode in a rectangular guide structure included in the structure 20. These devices 24, 25 further enable the structure 20 to be transferred or assembled to a microwave-frequency microstrip-type printed circuit by soldering.

Further, the structure 20 includes at least two conducting pillars 27 perpendicular to the plane of the structure 20, situated as close as possible to its principal axis without there being a coupling with the filter 22 and linking the upper and lower ground planes. In one embodiment of the invention, these pillars 27 are made as metallized interconnection holes passing through both dielectric layers 21, 23. In a second embodiment of the invention, the pillars 27 are solid metal rods.

The entire structure 20 according to the invention constitutes a band-pass filter free of distortion and of spurious response on a wide frequency band, and able to be assembled to a microwave-frequency microstrip-type printed circuit.

A non-negligible advantage of the structure according to the invention is its capability to be made by means of standard techniques for manufacturing microwave-frequency circuits and hence results in a relatively low production cost.

The invention claimed is:

1. A microwave-frequency filtering structure comprising:

two dielectric layers separated by a conducting layer, the conducting layer being etched in a pattern of a filter, wherein upper and lower exterior faces of a stack of the two dielectric layers are covered over a larger part of their surface by a conducting plane constituting upper and lower ground planes of the structure, wherein said upper and lower ground planes are interlinked by a metallization of a periphery of the structure, except in the vicinity of microwave-frequency ports, two identical devices, one of the two identical devices being an input transition device and the other one of the two identical devices being an output transition device, each allowing a passage from a microstrip mode to a stripline mode and vice-versa, configured such that a geometry of the transition device is optimized so as to minimize standing wave ratios at the ports of the filter, and to minimize an excitation and a coupling of a TE10 mode, and at least two conducting pillars perpendicular to the plane of the structure, which are situated as close as possible to a principal axis of the structure, without there being any coupling with the filter, and linking the upper and lower ground planes.

2. The structure according to claim 1, wherein each device of the two identical devices includes:

a metallized pad situated on a lower face of the device and on a minor side of the filter, an interconnection hole allowing a connection between the metallized pad and a stripline access line of the filter, and eight metallized pillars connected at each end to the ground planes.

3. The structure according to claim 1, wherein the two identical devices enable the structure to be assembled to a microwave-frequency microstrip-type printed circuit by soldering.

4. The structure according to claim 1, wherein the pillars are made as metallized interconnection holes passing through the two dielectric layers.

5. The structure according to claim 1, wherein the pillars are solid metal rods.

6. A printed circuit including a set of active and/or passive components, comprising one or more structure(s), according to claim 1.

7. The structure according to claim 1, wherein the at least two conducting pillars perpendicular to the plane of the structure include two pillars arranged on a first side of the conducting layer and two pillars arranged on a second side of the conducting layer, the second side being opposite to the first side, and wherein a first pillar of each of the two pillars is arranged closer to the conducting layer than a second of each of the two pillars so that the first of each of the two pillars is provided between the conducting layer and the second of each of the two pillars.

* * * * *